United States Patent [19]

Grenier

[11] 4,393,289

[45] Jul. 12, 1983

[54] CIRCUIT BREAKER

[75] Inventor: Aime J. Grenier, North Attleboro, Mass.

[73] Assignee: Texas Instruments Incorporated, Dallas, Tex.

[21] Appl. No.: 64,453

[22] Filed: Aug. 6, 1979

Related U.S. Application Data

[63] Continuation of Ser. No. 878,957, Feb. 17, 1978, Ser. No. 755,514, Dec. 30, 1976.

[51] Int. Cl.[3] ..... H01H 33/08; H01H 9/30

[52] U.S. Cl. ..... 200/147 R; 200/144 R

[58] Field of Search ..... 200/144 R, 147 R

[56] References Cited

U.S. PATENT DOCUMENTS

| | | | |
|---|---|---|---|
| 2,323,642 | 7/1943 | Baker | 200/147 R |
| 2,692,318 | 10/1954 | Few et al. | 200/147 R |
| 2,820,122 | 1/1958 | Teszner | 200/147 R |
| 2,830,158 | 4/1958 | Coleman | 200/147 R |
| 3,147,358 | 9/1964 | Melhart | 200/147 R |

*Primary Examiner*—Robert S. Macon

*Attorney, Agent, or Firm*—James P. McAndrews; John A. Haug; Melvin Sharp

[57] ABSTRACT

A high performance, manually and automatically operable, trip-free magnetic circuit breaker incorporates a double break contact system to achieve longer life, more reliable operation and improved rupture capacity.

4 Claims, 7 Drawing Figures

CIRCUIT BREAKER

This is a continuation of application Ser. No. 878,957, filed Feb. 17, 1978, a division of Ser. No. 755,514, filed Dec. 30, 1976.

Conventional high performance, manually and automatically operable, trip-free magnetic circuit breakers have been adaptable for use in series, shunt and relay trip application, for instantaneous or time delayed trip operation, for use as "flux switch" type circuit breakers where high transient currents in the breaker circuit have been anticipated, for use with auxiliary switches, and for use in multipole applications. However, such adaptability has been achieved only by substituting a substantial number of breaker components in adapting the breakers for each type of breaker operation. As a result, circuit breaker costs have been high due in part to the high unit cost of breaker components resulting from the need for many different tools and resulting from the small manufacturing volumes of some of the special breaker components. Breaker costs have also been increased by the need for maintaining a large inventory of many different breaker parts.

Most important, such conventional circuit breakers have required performance of a large number of critical hand operations during breaker assembly and calibration. These assembly operations have been time-consuming and expensive, have imposed excessive delay between customer order and delivery, have required the employment of skilled assembly personnel, have resulted in high rejection rates during assembly, have frequently prevented salvaging of components from improperly assembled breakers, and have resulted in the manufacture of breakers which have not displayed consistent performance characteristics.

For example, such known circuit breakers have frequently required welding of pigtails to movable contact arms, have utilized magnetic core means which have been soldered or cold-headed to the magnetic frame which supports the magnetic actuating coils in the breakers to obtain secure mounting of the core means relative to the coil means; and have required bending of latch components, clappers and the like at assembly to obtain proper interaction of breaker linkage systems with other breaker components. In some of the previously known circuit breakers, the collapsible linkages which have been used have required excessive riveting and in most such circuit breakers, breaker housing section have been riveted together after breaker assembly and calibration has been completed.

Each of these assembly operations used in manufacturing the conventional circuit breakers has tended to impose cost and performance penalties. Thus, the critical hand assembly operations have been slow and expensive to perform as will be understood. They have also resulted in assembly errors which have seriously reduced manufacturing yields. Welding and soldering tend to introduce splatter which can result in immediate breaker failure or which can result in failure of the breakers during subsequent use. Welding, soldering, cold-heading and bending also tend to destroy corrosion-preventing coatings provided on some breaker components. These assembly operations also introduce material stresses such as work-hardening which are deleterious to breaker performance. For example, welding of pigtails can result in stiff pigtail movement which prevents smooth movement of the contact arm during breaker operation. The cold-heading of a magnetic core means in mounting the core means on a coil-supporting frame introduces work-hardening which can result in the build-up of residual magnetism in the cold-headed components during subsequent use of the circuit breaker. Riveting of the components of a collapsible linkage risks tight operation of the linkage which can retard proper opening of the circuit breaker. Riveting of the casing also tends to result in cracking of dielectric casing parts. Further, where such welding, soldering, cold-heading or riveting result in errors of assembly, salvaging of the welded, soldered, cold-headed or riveted parts is usually difficult and expensive.

In addition, some previously known circuit breakers have been subject to various structural deficiences which have reduced the convenience or effectiveness of their performance. For example, where the housings of such breakers have been riveted together, the rivets have sometimes contributed to arcing or shorting outside the breaker housings particularly where high overload current conditions have occurred in multipole breaker applications. In most such known breakers the collapsible linkages have been subjected to heavy loads so that all of the linkage elements have been made of metal. In such linkages, even slight corrosion of the metal elements in metal-to-metal pressure engagement can result in retardation of linkage movement and such breakers have sometimes required lubrication when used in hostile environments. In other known breakers, where a clapper is adapted to be drawn into engagement with a magnet pole face and to strike a breaker tripping element during such movement, it has been difficult to precisely position the clapper to assure proper tripping. That is, if the clapper engages the tripping element too far away from the pole face, the clapper force may be too small to initiate tripping. On the other hand if the clapper strikes the tripping element too close to the pole face, the extend of the resulting movement of the tripping element may be insufficient to effect tripping.

In some previously known circuit breakers, calibration of the breaker units has been accomplished from the side of the breaker. Accordingly, when a group of such units is used in a multipole breaker application, the calibration had to be completed before assembly of the units in the desired multipole arrangement. However, because the individual breaker units have been subject to a different magnetic environment in the multipole arrangement, such calibration prior to a final assembly has not always been fully effective. Further, the prior art techniques used for coupling breaker handles and the like in multipole applications have tended to be somewhat inconvenient to use. In addition, where previously known breakers have been used with auxiliary switches, the additional forces required for operation of the auxiliary switches have sometimes made it difficult to properly calibrate the breakers or to obtain uniform and reliable breaker performance. Similarly, where the prior art breakers have been adapted for flux switch operation, the breakers have been difficult to calibrate and have not always been adapted to withstand suitably high transient current without nuisance tripping.

It is an object of this invention to provide a novel and improved, high performance, manually and automatically operable, trip-free magnetic circuit breaker; to provide such a circuit breaker which is of compact, rugged and inexpensive construction; to provide such a breaker which is readily adaptable at low cost for use in a wide variety of circuit breaker applications; to provide such a circuit breaker which is easily and rapidly assembled; to provide such a breaker which is adapted to be assembled without requiring hand adjustments during such assembly; to provide such circuit breakers which display consistent performance characteristics; to provide such circuit breakers which are of compact construction and small size but which display improved rupture capacity; to provide such circuit breakers which are adapted to be easily, accurately and conveniently calibrated; to provide such circuit breakers which are easily and accurately calibrated after assembly in a multipole circuit breaker arrangement; to provide such circuit breakers which are adapted to withstand substantial wear over a long service life; to provide such circuit breakers which display improved resistance to corrosion and which are significantly less subject to jamming as a result of corrosion; to provide such circuit breakers which are operable in hostile environments without requiring lubrication; to provide such circuit breakers in which build-up of residual magnetism does not tend to occur; to provide such circuit breakers from which breaker components are easily salvaged at any time; to provide such circuit breakers which do not require extensive riveting during assembly; to provide such circuit breakers which are adapted to be manufactured with high manufacturing yields; to provide such circuit breakers which are easily mounted on control panels; to provide such circuit breakers which are easily calibrated after adaptation for auxiliary switch application; to provide such circuit breakers which are conveniently coupled together for multipole operation; and to provide such circuit breakers which are easily calibrated and which display reduced nuisance tripping when adapted for flux type circuit breaker application.

Briefly described, the circuit breaker of this invention comprises a pair of dielectric casing sections fitted together to form a housing having terminal openings between the sections at one end of the housing. Abutments are provided on the exterior surfaces of the casing sections adjacent the openings, and terminals which are disposed in the openings have tabs deformed around the abutments for holding the casing sections together at the end of the housing. Mounting and cam surfaces are also provided on the exterior surfaces of the casing sections at the corners of the opposite end of the housing. Metal clips fit over these exterior casing surfaces, the clips having cam surfaces engaged with the cam surfaces on the casing sections for holding the casing sections together with a precisely predetermined force. The clips have detent means which position the clips until circuit breaker assembly has been tested and have tabs which are deformed after testing for locking the clips permanently in place. The clips are provided with tapped mounting holes. In this arrangement, the housing is easily and accurately assembled without risk of cracking the dielectric casing sections; the housing is free of rivets which might reduce electrical clearances in the breaker; if dissassembly is required, the casing sections and clips are fully reuseable; and the housing is adapted for conveniently mounting on a control panel without requiring mounting inserts in the housing.

The circuit breaker also includes an improved contact system in which a pair of first contacts are mounted in spaced relation in the housing and in which a movable contact arm is pivotally mounted on the housing for moving a bifurcated end of the arm into and out of bridging engagement with the first contacts for opening and closing the breaker circuit. The movable contact arm is normally biased to open circuit position. In this arrangement, no pigtails need be welded to the movable contact arm; a double contact break is obtained; and the arrangement of the contact arm is adapted to achieve improved blow out of arcs formed during opening of the breaker circuit. Thus the current breaker achieves more consistent performance, longer service life and improved rupture capacity.

The circuit breaker also includes an improved collapsible linkage for permitting opening and closing of the breaker circuit in response to manual movement of an operating handle and for permitting automatic opening of the breaker circuit when the linkage is tripped on the occurrence of an overload current on the circuit. In the linkage, a first link has one end pivotally connected to the operating handle and has a first latch which is engaged with the contact arm and which is pivotally mounted at the opposite end of the first link for movement between latching and unlatching positions. The first latch has a cam surface to be engaged for manually holding the first latch in its latching position. A second link having a cam follower is pivotally mounted on the first link for movement between a first position engaging the cam follower with the cam surface of the first latch for holding the first latch in its latching position and a second position in which the cam follower is disengaged from the first latch. A second latch, also pivotally mounted on the first link, is movable from a latching position holding the second link in its first position to an unlatching position in which the second link is permitted to move to its second position. A tripping member also pivotally mounted on the first link normally holds the second latch in its latching position but is trippable by an applied force for releasing the second latch for movement to its unlatching position. When the first and second latches are in the latching positions as described, movement of the operating handle between two circuit position, is effective to move the linkage through an overcenter position against the bias on the movable contact arm, thereby to hold the arm securely in closed circuit position or to permit the arm to move sharply to open circuit position. Tripping of the tripping member by an applied force on the occurrence of an overload current in the breaker circuit is also effective to collapse the linkage for permitting the contact arm to move sharply to open circuit position independently of the position of the operating handle.

In the dual latch linkage system of this invention, the links, latches and tripping member are arranged to provide cumulative mechanical advantage such that, although the movable contact arm is normally held in closed circuit position with substantial force, the tripping member is adapted to retain the second latch in its latching position with a much smaller force. Preferably also the tripping member is formed of precision molded plastic high lubricity material. In this arrangement, only a relatively light for need be applied to the tripping member for initiating automatic circuit-opening operation of the circuit breaker. Further, although the plastic tripping member is adapted to withstand the light forces applied to it without cold flow or excessive wear, the tripping member is formed with such precision that the linkage is adapted to be easily and accurately assembled inside the circuit breaker and does not require cutting, trimming or bending or the like during final circuit breaker assembly. In addition, the plastic tripping member is not subject to corrosion even in hostile environments and there is no metal-to-metal pressure contact between the plastic tripper and the second latch. Accordingly, the linkage provides smooth and consistent circuit breaker performance and does not require lubrication at assembly.

The circuit breaker of this invention also includes a clapper which is magnetically movable from a rest position to an actuating position for tripping the tripping member of the collapsible linkage as above described, a magnetic frame supporting a magnetic coil to be responsive to current conditions in the breaker circuit, and magnetic core means fitted within the coil to cooperate with the frame in defining a magnetic circuit for moving the clapper to its actuating position on the occurrence of an overcurrent condition on the breaker circuit. The frame engages abutments formed in the inner surfaces of the casing sections of the housing for mounting and precisely locating the frame within the housing chamber; the coil is wound on a hollow spool mounted on the frame, the spool having resilient fingers positioned at one end of the spool; the core has a flange at one end engaged with additional abutments on the casing sections for mounting and precisely locating the core in the chamber while permitting the core to extend into the coil to be precisely located relative to the coil by engagement with the resilient fingers on the coil spool; and the clapper engages other abutments on the casing for mounting and precisely locating the clapper for pivotal movement relative to the core and frame within the housing chamber. Preferably, the clapper engages additional abutment means on the inner surface of the casing section for properly positioning the clapper in its rest position in the chamber. Preferably also the portion of the operating handle pivotally connected to the collapsible linkage engages other abutments on the inner surface of the casing sections. In this arrangement, where the operating handle and the various magnetic components of the circuit breaker are all located by abutments provided on the same precision molded casing sections, the components are easily and accurately located in the breaker relative to each other and to the tripping member of the collapsible linkage. The magnetic components are accurately located without requiring cutting, bending or trimming during final circuit breaker assembly and without requiring soldering or cold heading or the like such as might introduce work hardening or other undesired material stresses. The magnetic components are also easily disassembled for salvaging or the like free of damage to any of the components whenever such disassembly is desired.

The circuit breaker also includes an improved calibration system in which a calibrating member has a first portion rotatably mounted in the housing wall adjacent the operating handle and has a second threaded portion extending into the housing chamber to be rotatable with the first portion. A tension coil spring has a convolution at one end fitted in threaded engagement with the threaded portion of the calibrating member and has its opposite end connected to the clapper for biasing the clapper to its rest position, whereby the spring applies a selected force to the clapper in a selected direction but is movable in response to rotation of the calibrating member for threadedly advancing said one end of the spring on the calibrating member. In this way, the spring applies substantially the same spring force to the clapper but applies that force in a different direction so that the spring force has a different moment arm relative to the clapper pivot for calibrating the circuit breaker. In this arrangement, substantial rotation of the calibrating member produces small variation of the bias on the clapper to achieve high resolution in calibration of the breaker. The calibration system is also compact and inexpensive and is located at the operating handle end of the breaker to be readily accessible even when several of the circuit breakers are mounted together in a multiple circuit breaker application. The calibrating member is also substantially free of springback for assuring accurate calibration; the spring is not subjected to greatly varying stresses during use and therefore provides consistent performance at various calibrations over a long service life; and where initial tension is provided in a spring with a low spring rate as is preferred, the spring provides the desired torque in a compact spring configuration while assuring that the torque does not increase significantly as the clapper is moved between its rest and actuating position, thereby resulting in a snappier clapper action.

The circuit breaker also includes an improved auxiliary switch mechanism; an improved flux member for use in adapting the breaker for flux type circuit breaker application; an improved multipole actuator system for tripping all of the circuit breakers in a multipole breaker when one of the poles has been tripped; an improvement system for ganging operating handles of the circuit breaker units in a multipole circuit breaker; alternate terminals for use in adapting the circuit breaker for series, shunt or relay type applications; and a modular construction which permits convenient adaption of the breaker for use in a variety of different types of circuit breaker applications.

Other objects, advantages and details of the circuit breaker of this invention appear in the following detailed description of preferred embodiments of the invention, the detailed description referring to the drawings in which.

Figure 1:
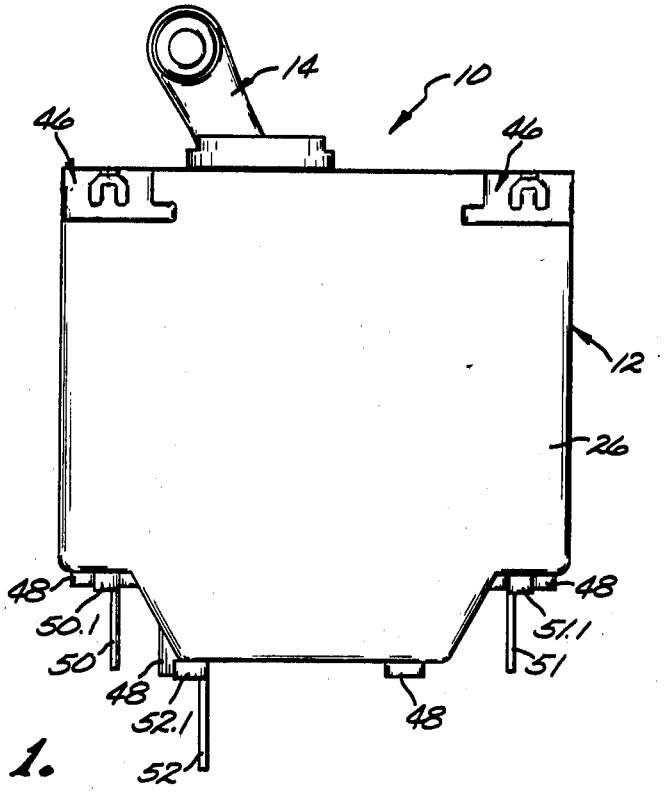
FIG. 1 is a side elevation view of a shunt trip embodiment of the circuit breaker of this invention.
Figure 2:
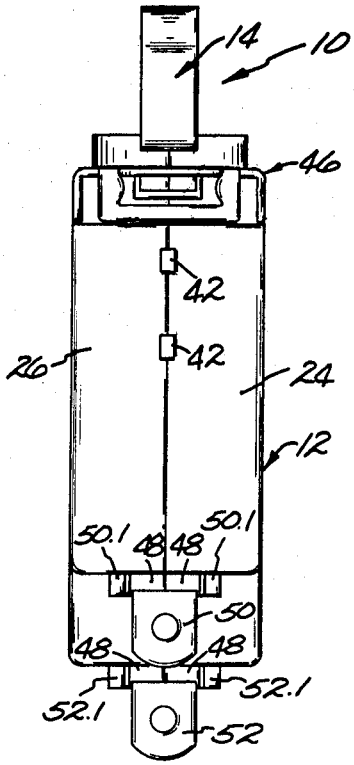
FIG. 2 is one end elevation view of the circuit breaker of FIG. 1.

Referring to the drawings, 10 in FIGS. 1–7 indicates a preferred embodiment of the novel and improved circuit breaker of this invention which provides for manual opening and closing of a circuit and for automatic, trip-free operation in response to the occurrence of an overload current or voltage in the circuit and which, in the embodiment illustrated in FIGS. 1–7, is adapted for shunt-trip type of circuit breaker application. As illustrated, the circuit breaker 10 is shown to include a housing indicated generally at 12, an operating handle 14, a contact system indicated generally at 16 (see FIGS. 3–7), a collapsible linkage 18 (see FIGS. 3–5), a magnetic actuation system indicated generally at 20 (see FIGS. 3–5), and a calibration system indicated generally at 22 (see FIGS. 3–5).

Figure 3:
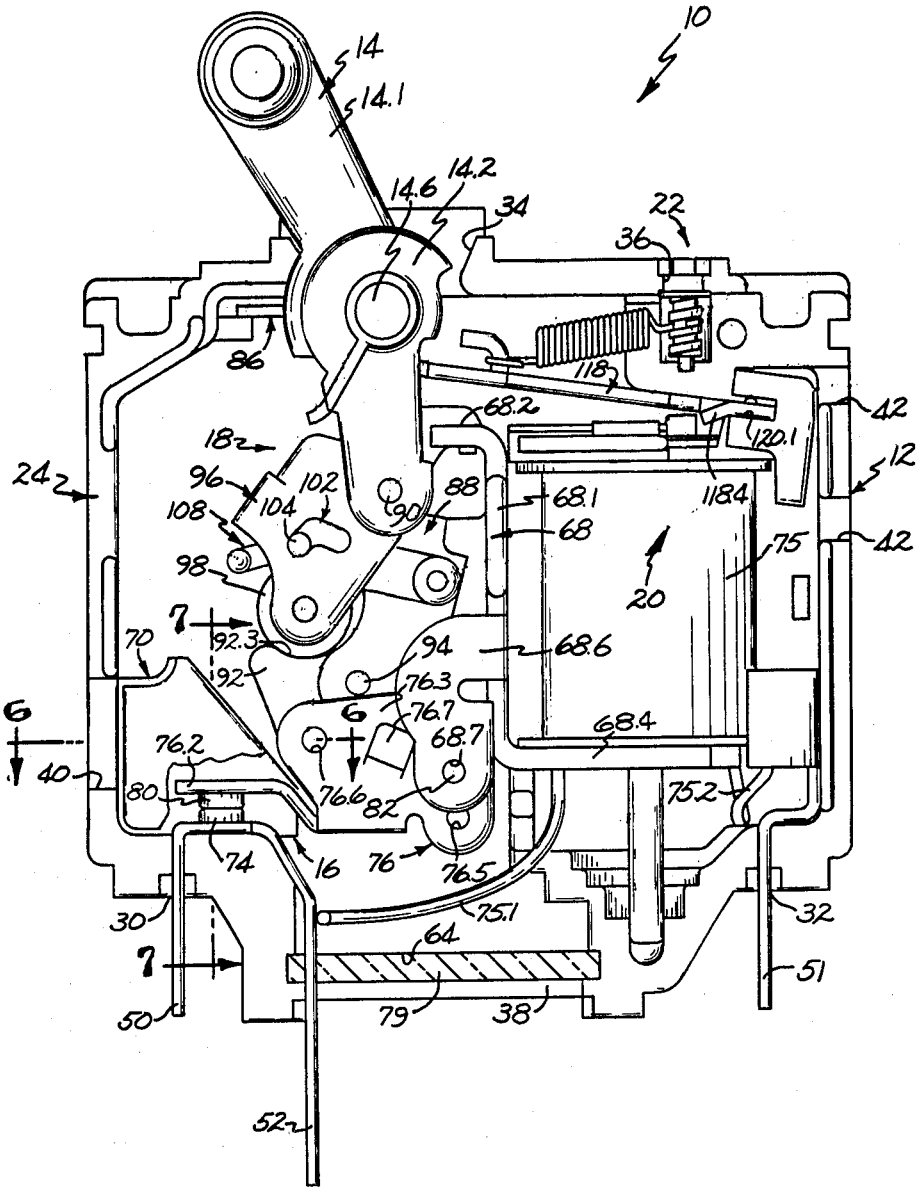
FIG. 3 is section view showing the movable circuit breaker components mounted in the casing section of FIG. 7 with circuit breaker.
Figure 4:
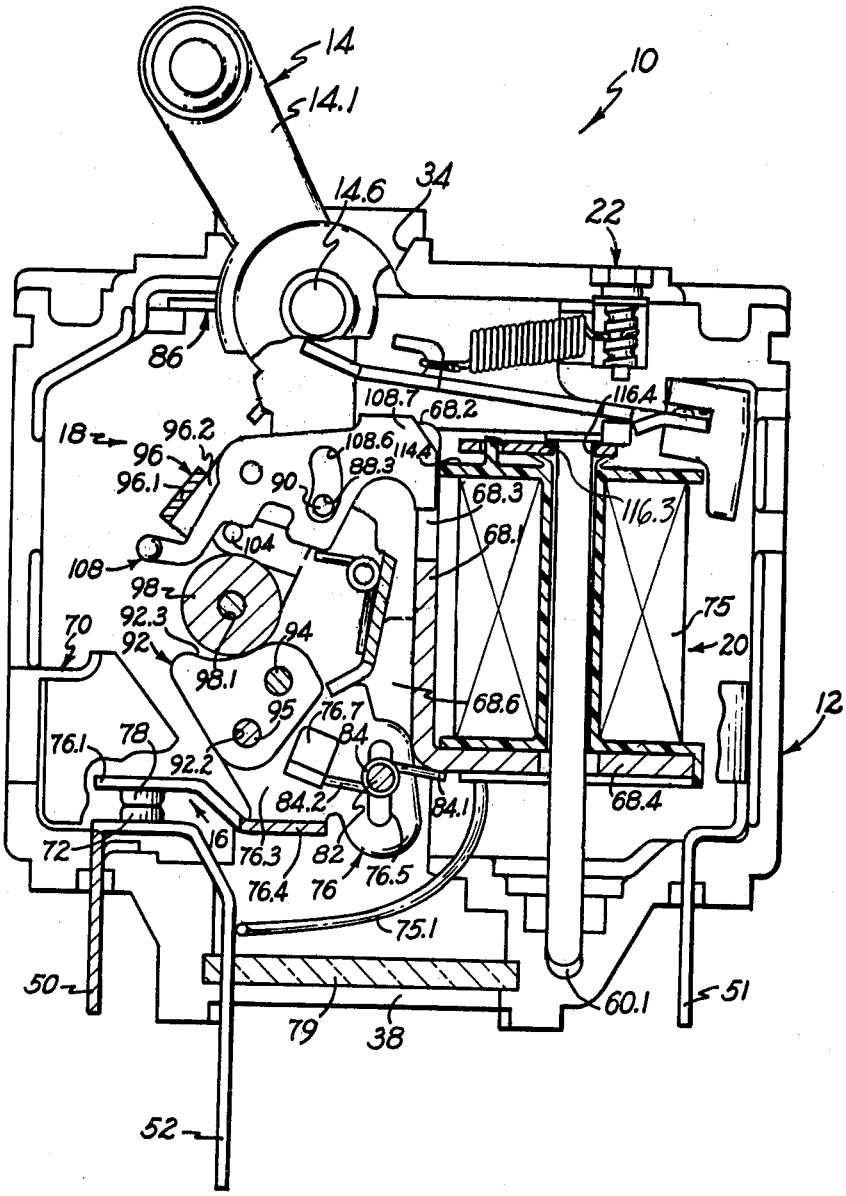
FIG. 4 is a section view similar to FIG. 3 and showing the movable circuit breaker components in section.
Figure 5:
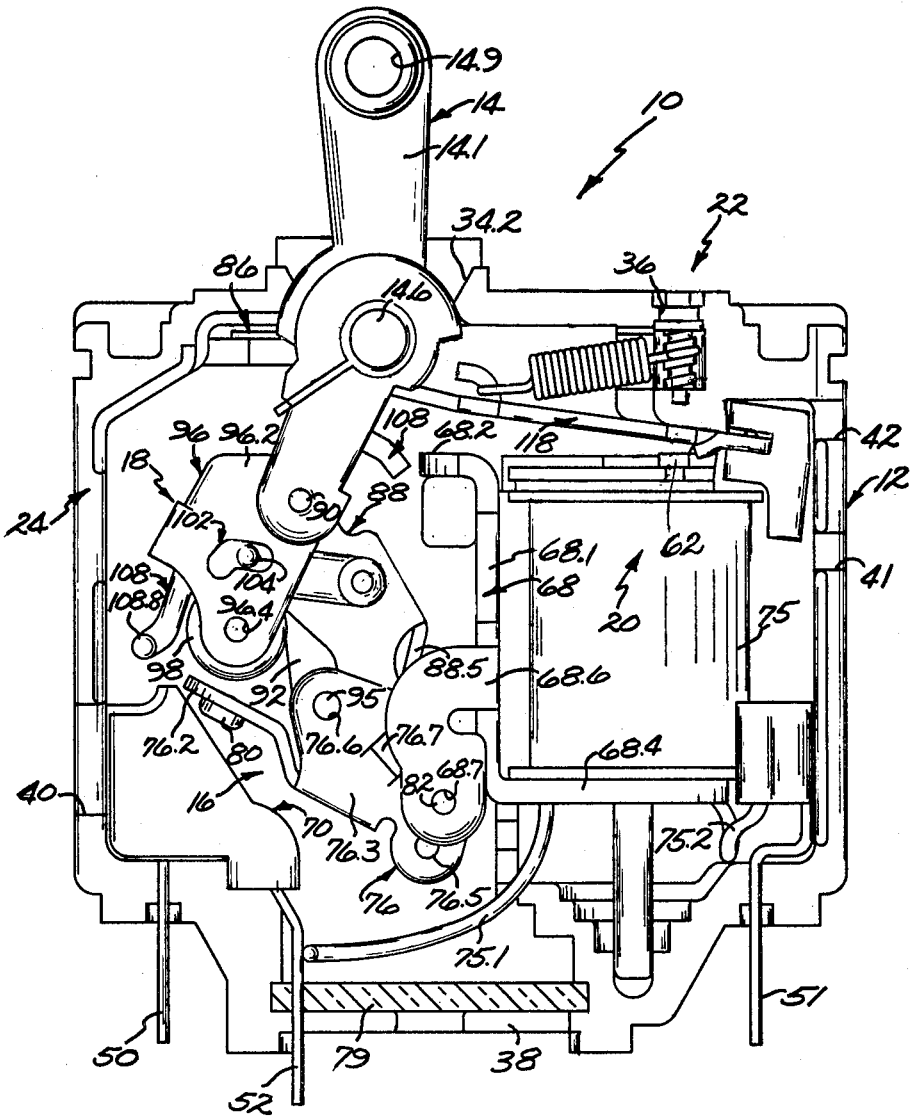
FIG. 5 is a section view similar to FIG. 3 showing the movable circuit breaker components as the circuit breaker is initiating movement to open circuit position on the occurrence of an overload in the breaker circuit.
Figure 6:
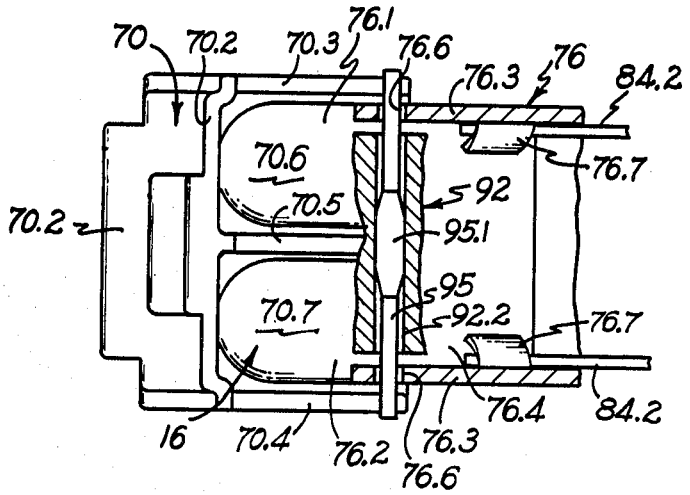
FIG. 6 is a partial section view along line 6—6 of FIG. 3.
Figure 7:
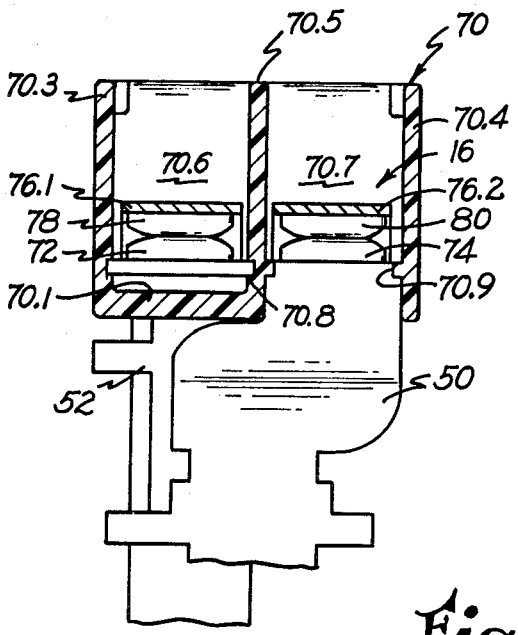
FIG. 7 is a partial section view along line 7—7 of FIG. 3.

The base or housing 12 embodies a pair of casing or housing sections 24 and 26 of a rigid dielectric material such as thermoplastic polyester, phenolic resin, glass-filled nylon or the like which are preferably formed in precision molding processes or the like so that each casing section has a plurality of structural features precisely located relative to each other on the section at very low cost. The casing section 26 is of generally similar configuration, the edge walls of the two casing sections being fitted together to define a housing chamber 28 as shown in FIGS. 3–5. The edge walls of the casing sections also have recesses, notches or slots which cooperate when the sections are fitted together to define a plurality of openings extending into the housing chamber 28, these openings including terminal openings 30 and 32 at one end of the housing 12, a bottom opening 38 at that end of the housing, an opening 34 for the operating handle 14 at the opposite end of the housing 12 and an opening 36 for the calibration system 22 adjacent to the operating handle opening at said opposite housing end. Preferably such slots and the like in the edge walls of the casing sections also cooperate to form an arc vent opening 40 and test openings 42 (see FIG. 2) in the housing as is discussed further below.

In accordance with this invention the exterior surfaces of the casing sections have a plurality of mounting surfaces and the like integrally formed on the casing sections and precisely located relative to each other on the casing exterior for use in achieving convenient, accurate and high-yield assembly of the housing 12.

A metal mounting clip 46 has various structural features which cooperate with the mounting surfaces to hold the casing sections together, temporarily or permanently, to form the housing 12.

Preferably, abutments 48 are also formed on the exterior surfaces of the casing sections 24 and 26 adjacent each of the terminal openings 30 and 32, and preferably adjacent each side of the bottom opening 38, at the other end of the housing 12. Breaker terminals 50 and 51 fitted into the openings 30 and 32 are then provided with tabs 50.1 and 51.1 which are deformed around pairs of the exterior casing abutments 48 adjacent the terminal openings after final breaker assembly for securely locking the casing sections together at that end of the housing. Where the circuit breaker 10 is adapted for shunt-trip type of circuit breaker operation as shown, an additional terminal 52 is extended through the bottom opening 38 in the housing 12 and tabs 52.1 on that terminal are deformed around a pair of the abutments 48 adjacent the opening 38.

In accordance with this invention, the casing sections 24 and 26 are also provided with a plurality of integral mounting surfaces, abutments and the like on the interior surfaces of the casing sections, whereby these interior casing features are also precisely located relative to each other in an inexpensive way for use in precisely locating various circuit breaker components relative to each other within the housing chamber 28. Such interior casing features (which are each discussed further below) include a recess 54 for use in pivotally.

In the circuit breaker 10 of this invention, a frame 68 of a magnetically permeable metal material such as annealed steel is mounted in a central position in the housing chamber 28 as shown in FIG. 3.

In the contact system 16 of the circuit breaker 10, an arc chute member 70 of a rigid dielectric material such as phenolic resin, glass-filled thermoplastic polyester or the like has a bottom wall 70.1, has an end wall 70.2, and has a pair of sloped outer side walls 70.3 and 70.4 spaced at either side of a similarly sloped central dividing wall 70.5 for forming contact chambers 70.6 and 70.7 at respective opposite sides of the dividing wall. See FIGS. 6 and 7. The outer side wall 70.3 and the dividing wall 70.5 have corresponding grooves 70.8 receiving the edges of one end of the breaker terminal 52 therein for mounting a first fixed contact 72 secured to the terminal 52 within the contact chamber 70.6. The bottom wall 70.1 of the arc chute member has a recess 70.9 therein and is open adjacent the end wall 70.2 for receiving one end of the breaker terminal 50 therein, thereby to mount a second fixed contact attached to the terminal 50 within the contact chamber 70.7. The arc chute member 70 is mounted in the recess 56 in the casing section 24, and in a corresponding recess in the casing section 26 while the opposite ends of the terminals 50 and 50 are extended from the housing chamber 28 through openings 30 and 38 respectively in the housing 12. The terminal 51 is similarly mounted between the casing sections to extend from the housing chamber through the opening 32 in the housing. The end wall 70.2 of the arc chute member has a gridded aperture formed therein, whereby the gridded aperture is aligned with the opening 40 in the housing so that the contact chambers 70.6 and 70.7 are each separately vented outside the circuit breaker housing 12. When a magnetic actuation coil 75, to be discussed further below, is mounted on the coil support arm 68.4 of the frame member, one end of the coil is electrically connected to the line terminal 51 while the opposite end of the coil is electrically connected to the shunt-trip terminal 52 as shown in FIG. 3.

In the contact system 16 of the circuit breaker 10, a second contact means, preferably a movable contact arm 76 of an electrically conductive metal material such as copper or brass, is also mounted for pivotal movement on the frame member 68. The contact arm has one end bifurcated as indicated at 76.1 and 76.2 (see FIG. 5), has a pair of spaced, integral, juxtaposed wings 76.3 at its opposite end fitted between the wings 68.6 of the frame member, and has an intermediate arm portion 76.4 which electrically connects the bifurcated arm ends to each other. A pair of electrical contacts 78 and 80 are mounted on the respective bifurcations 76.1 and 76.2, these bifurcated arm ends preferably being stepped as shown so that the intermediate arm portion 76.4 electrically connecting the bifurcations is disposed in substantially the same plane as the outer surfaces of the contacts 78 and 80. The wings 76.3 of the movable contact arm have respective aligned slots 76.5 therein, have respective aligned pivot pin holes 76.6, and each preferably have a tab 76.7 struck therefrom to extend toward the other wing of the contact arm. A pivot pin 82 extends through the contact arm slots 76.5 and through pivot pin holes 68.7 in the frame and the ends of the pin are positioned closely adjacent the principal walls of the casing sections 24 and 26 to assure retention of the pin in the slots 76.5 and holes 68.7. A double section coil spring fitted over the pin 82 has a central bight 84.1 bearing against the frame 68 and has its opposite ends 84.2 fitted under respective tabs 76.7 on the movable contact arm, thereby to bias the arm for pivotal movement in a clockwise direction as viewed in FIGS. 3 and 4. A pair of coiled torsion springs (right and left) could also be used.

In this arrangement, the contact arm 76 is pivotally mounted on the frame 68 for moving the bifurcated end of the contact arm toward or away from the plane occupied by the fixed contacts 72 and 74, whereby the contacts 78 and 80 are engaged with or disengaged from the respective fixed contacts 72 and 74. In this way, the contact arm is adapted to close a circuit between the fixed contacts 72 and 74 by bridging the fixed contacts. However, the arm is normally biased by the spring 84 to open that bridging circuit. Because a bridging circuit is adapted to be closed by pivoting of the contact arm 76, the convenience and desirable contact closing forces obtained with a pivotal contact arm are achieved but no flexible pigtail or the like such as might tend to retard smooth pivoting of the contact arm, or which might be subject to fatigue during use, need be attached to the movable arm. Further the use of the bridging contact arm 76 provides a double contact make and break in closing and opening the noted circuit, thereby permitting the contact system 16 to function with greater speed and with less arc erosion damage to the breaker contacts and to provide the breaker 10 with greater rupture capacity. The bifurcated ends 76.1 and 76.2 of the contact arm fit into respective contact chambers 70.6 and 70.7 so that the mating pairs of contacts 72–78 and 74–80 are separated by the dividing wall 70.5 as the mating contact pairs are engaged and disengaged. In this way the fixed contacts 72 and 74 are adapted to be spaced closed together without risk of arcing therebetween and each mating contact pair is shielded from arc erosion splatter or the like originating at the other mating contact pair. Further, with this arrangement of the contact system 16, magnetic fields are formed by current flow in the terminals 50 and 52 and in the contact arm 76 during opening of the breaker circuit such that arcs formed between the mating contact pairs tend to remain separate and tend to be deflected in directions away from the contact arm to be vented from the contact chambers 70.6 and 70.7 through the housing vent opening 40 and to be extinguished in passing through the gridded aperture in the arc chute end wall 70.2. In this way, the single, one piece arc chute 70 handles all arcing problems and also facilitates contact mounting. Desirably, a cover member 79 of a stiff fiberboard material or the like, apertured to pass the terminal 52 therethrough, is mounted over the bottom opening 38 of the housing by disposing the edges of the cover in the slot recess 64 of the casing section 24 and in a corresponding slot recess in the casing section 26.

In the circuit breaker 10, the operating handle 14 is formed of a rigid dielectric material such as glass-filled nylon or the like and is provided with a manually movable portion 14.1 which extends in one direction from a central bridging portion 14.2 of the operating handle.

In accordance with this invention, the circuit breaker 10 also includes a novel and improved collapsible linkage 18 for connecting the operating handle 14 to the movable contact arm 76.

The circuit breaker 10 is adapted to achieve consistently, uniform operation as is hereinafter described. That is, with the circuit breaker 10 in a closed circuit position as illustrated in FIG. 3, a circuit extends from the load terminal 51, through the coil 75 to the fixed contact 72 carried by the terminal 52, through the contacts 78 and 80, the bifurcated ends 76.1 and 76.2, and the intermediate portion 76 of the movable contact arm to the fixed contact 74 carried by the terminal 50. If desired for connecting the breaker 10 for conventional shunt trip operation, exterior electrical connection can be made to the terminal 52. The movable contact arm 76 is normally held in its closed circuit position bridging the contacts 72 and 74 as shown in FIG. 3 by disposition of the operating handle 14 in its closed circuit position to hold the collapsible linkage in an overcenter position. That is, when the position shown in FIG. 3, the pivot pin 90 is disposed to the right of a line between the pivot pin 94 and the pivot pin means 14.6 on the operating handle under biase from the contact arm springs 84. The first latch 92 is normally held in its latching position by engagement of the cam follower roller 98 with the cam surface 92.3 of the first latch. The second link 96 is normally restrained in its first position holding the roller 98 engaged with the cam surface 92.3 by the engagement of the second latch pin 104 in the slots 102 of the second link. The second latch pin is held in its latchin position by the tripper 108. The arm 108 of the tripper is disposed in the clearance slot 68.3 of the frame with the actuating nose 108.7 positioned a precise distance above the pole face 68.2 of the frame. The clapper 118 is disposed in its rest position under a predetermined bias as determined by the adjustment of the calibration system 22. In this situation, normal current flows in the noted breaker circuit.

If manual opening of the breaker circuit is desired, the operating handle 14 is manually moved to its open circuit position moving the pivot pin 90 through an ovencenter position to the left of the line between the pivot pin 94 and the pivot pin means 14.6 on the operating handle. As the pivot pin moves across that noted line, restraint of the movable contact arm 76 is released and the arm moves to its open circuit position under the bias of the spring 84. As initial circuit opening movement of the contact arm 76 occurs, when arcing between the mating contact pairs 72–78 may occur, the magnetic field established around the terminals 50 and 52 and around the bifuracted ends of the contact arm by the current still flowing in the breaker circuit, keep the noted arcs separated from each other and deflect the arcs away from the contact arm to be vented from the breaker and extinguished as the arcs pass through the gridded aperture in the arc chute member. During such manual opening of the breaker circuit, the first latch 92, the second latch pin 104 and the tripping member 108 remain in their positions relative to each other as illustrated in FIG. 3.

However, if an overload current occurs in the breaker circuit, the magnetic field established by the flow of such overload current is directed through the main magnetic circuit of the breaker as previously described. The clapper 118 then moves sharply from its rest position (see FIG. 3) to its actuating position as shown in FIG. 5, thereby striking the actuating nose 108.7 of the tripper of the linkage 18 to initiate collapsing of the linkage. That is, the tripper 108 is rotated to its econd position on the pin 110 for releasing the second latch pin 104. The second latch pin moves in the slots 102 in the second link permitting the second link to ride off the cam surface of the first latch 92 for permitting the first latch to rotate under bias of the spring 84 and for permitting the movable contact arm 76 to move sharply to its open circuit position as the collapsing of the linkage 18 occurs. A position of the circuit breaker components at this collapsing of the linkage occurs is illustrated in FIG. 5. Subsequently, the operating handle 14 then moves to its open circuit position under the bias of its spring 86, this movement of the operating handle further moving the linkage to the position wherein the tripper, the second latch pin, and the first latch are returned to their latching positions for resetting the circuit breaker to permit manual reclosing of the circuit breaker. The stop 88.5 on the first link 88 assures that the first latch 92 is properly positioned for such resetting by limiting counterclockwise rotation of the first latch. The movement of the linkage to its rest position snaps the tripper against the clapper 118 to assure that the clapper is returned to its rest position and does not tend to stick to the magnet pole faces 68.2 nad 116.4 due to any residual magnetism. If manual reclosing of the circuit breaker is attempted while the overcurrent condition still exists in the circuit monitored by the breaker, reclosing of the breaker contacts results in immediate movement of the clapper 118 to cause collapse of the linkage 18 and reopening of the breaker circuit. Thus the breaker displays trip-free operation and cannot be held in closed circuit position while such an overcurrent condition continues.

However, if the overload current condition continues so that the core 162.1 is moved toward the cap end of the core means, this core movement changes the spacing between the core 162.1 and the cap 162.5 which is common to both magnetic circuits. This change of spacing decreases the reluctance in The improved core, clapper and coil mounting and flux switch magnetic circuit system described herein is described and claimed in the commonly assigned, copending application for patent of Aime J. Grenier, Ser. No. 755,515, now U.S. Pat. No. 4,085,393, filed of even date herewith.

The improved housing and mounting system described herein is described and claimed in the commonly assigned, copending application for patent of Aime J. Grenier, Ser. No. 755,780 now U.S. Pat. No. 4,087,772, filed of even date herewith.

The improved multipole breaker system described herein is described and claimed in the commonly assigned, copending application for patent of Aime J. Grenier, Ser. No. 755,763, now U.S. Pat. No. 4,114,122, filed of even date herewith.

The improved calibration system described herein is described and claimed in the commonly assigned, copending application for patent of Aime J. Grenier, Ser. No. 755,516 now U.S. Pat. No. 4,114,123, filed of even date herewith.

It should also be understood that although particular embodiments of this invention have been described above by way of illustrating the invention, the invention includes all modifications and equivalents of the described embodiments falling within the scope of the appended claims.

I claim:

1. A contact system for a circuit breaker comprising a pair of first electrical contacts which are disposed in spaced relation to each other in a common plane, and an electrically conductive contact arm having bifurcations at one end which are spaced apart along a line to be simultaneously engaged with the respective first contacts, said arm having an intermediate arm portion which extends parallel to said line to electrically connect the bifurcations to each other at a location closely adjacent to said one arm end, said arm having an additional portion extending from said intermediate arm portion to an opposite end of the arm, and said arm having said opposite end pivotally mounted on an axis which extends parallel to said line for pivoting the bifurcations in a first arc around said axis in side-by-side relation to each other and for pivoting said intermediate arm portion around said axis in a second arc spaced radially inward from the first arc, said arm being pivotable for moving the bifurcations between a closed circuit position in which the bifurcations lie in said plane engaging the first contacts and an open circuit position in which the bifurcations are moved out of said plane away from the respective first contacts, and said intermediate arm portion being located so that said intermediate arm portion is disposed in said plane at one side and radially inward from said line closely adjacent to said first contacts as the arm is moved into and out of said closed circuit position and so that electrical current flowing in said bifurcations and in said intermediate arm portion during said circuit opening and closing deflects electrical arcs formed between the bifurcations and contacts during said circuit opening and closing in a direction away from the contacts and away from the contact arm.

2. A contact system as set forth in claim 1 having an arc chute member of a dielectric material having a bottom wall, an end wall upstanding from the bottom wall, a pair of side walls upstanding from the bottom wall and extending laterally from the end wall, and a central wall upstanding from the bottom wall and extending laterally from the end wall between said side walls in spaced relation to the side walls for defining a pair of contact chambers, said contact chambers accommodating respective first contacts therein and permitting said contact arm bifurcations to be moved into and out of said contact chambers during movement of said contact arm between said open and closed circuit positions.

3. A contact system as set forth in claim 2 having a pair of terminals each having a first leg and a second leg angularly disposed relative to said first leg, having an aperture in the bottom wall of the arc chute member adjacent the end wall of the arc chute member opening into one of said contact chambers, having said first contacts mounted in respective first legs of said terminals within respective contact chambers of the arc chute member with a first selected spacing between the first contacts, and having said second terminal legs extending from the contact chambers with a spacing therebetween relatively greater than said first spacing, one of said second terminal legs extending from said one contact chamber through said bottom wall aperture.

4. A contact system as set forth in claim 3 having means securing said terminals to said arc chute member.

* * * * *